US006022092A

United States Patent [19]

Misumi

[11] Patent Number: 6,022,092

[45] **Date of Patent: *Feb. 8, 2000**

[54] INK JET RECORDING APPARATUS WITH MEANS FOR EQUALIZING INK DROPLET VOLUMES

[75] Inventor: Yoshinori Misumi, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/207,666

[22] Filed: Mar. 9, 1994

[30] Foreign Application Priority Data

Mar. 10, 1993 [JP] Japan ..... 5-049101

[51] Int. Cl.[7] ..... B41J 2/01

[52] U.S. Cl. ..... 347/10; 347/11; 347/15; 347/57

[58] Field of Search ..... 347/57, 10, 11, 347/15; 346/140.1

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,558,333 | 12/1985 | Sugitani et al. | 347/65 |
| 4,608,577 | 8/1986 | Hori | 347/66 |
| 4,631,548 | 12/1986 | Milbrandt | 347/15 |
| 4,723,129 | 2/1988 | Endo et al. | 347/56 |
| 4,740,796 | 4/1988 | Endo et al. | 347/56 |
| 5,032,851 | 7/1991 | Yoshimura | 347/57 |
| 5,121,131 | 6/1992 | Bouldin et al. | 347/2 |
| 5,252,986 | 10/1993 | Takaoko et al. | 347/57 |

FOREIGN PATENT DOCUMENTS

| | | |
|---|---|---|
| 54-056847 | 5/1979 | Japan . |
| 59-123670 | 7/1984 | Japan . |
| 59-138461 | 8/1984 | Japan . |
| 60-071260 | 4/1985 | Japan . |

*Primary Examiner*—John Barlow
*Assistant Examiner*—Craig A. Hallacher
*Attorney, Agent, or Firm*—Fitzpatrick, Cella, Harper & Scinto

[57] ABSTRACT

An ink jet recording apparatus includes an ink jet recording head which has an ink ejection outlet, an ink passage, a heater for heating ink to form a bubble in the ink so as to allow a part of the ink to be ejected from the ink ejection outlet in the form of an ink droplet, and a driving circuit for applying a driving signal group to the heater. The driving signal circuit serves to apply a driving signal group including one or more pulses per a single pixel to the heater corresponding to the value representing an input image signal. In response to this input image signal, an ink droplet group having independent ink droplets is ejected from the ejection outlet toward a recording sheet. Since a quantity of ink ejected per a single pixel is variably controlled by changing the number of ink droplet ejection, each recording operation can be achieved while maintaining excellent gray scale properties.

26 Claims, 14 Drawing Sheets

INK JET RECORDING APPARATUS WITH MEANS FOR EQUALIZING INK DROPLET VOLUMES

BACKGROUND OF THE INVENTION

1. Field of the Invention

The present invention relates generally to an ink jet apparatus. More particularly, the present invention relates to an ink jet apparatus which assures that each recording operation can be performed with excellent gray scale (gray level) level properties.

2. Description of the Related Art

As is well known, much attention has been paid to an ink jet system especially in consideration of the fact that since the ink jet system is operated in accordance with the principle of a non-impact recording process, the ink jet system exhibits excellent quietness during each recording operation, and moreover, it makes it possible to achieve each recording operation at a high speed, and to form colored images each having excellent saturation on recording paper.

Among plural types of ink jet systems available at present, an ink jet system of the type having thermal energy generated by a heater or the like utilized therefor makes it possible to construct the ink jet system with small dimensions, employ a multi-orifice for executing the ink jet system or arrange a plurality of orifices at a high density.

In practice, the ink jet system having thermal energy utilized therefor in that way has many advantages as mentioned above, but in the case that it is required that images each having a high quality are recorded on a recording sheet, it is desirable that images each including a halftone information are recorded on the recording sheet with acceptable gray scale properties.

As a method of expressing a gray scale employable for an ink jet apparatus, there has been known an ink jet method practiced by ejecting plural kinds of inks (each having a different color or a different density) from each of a plurality of ejection outlets in response to an image signal containing information on a gray scale with a plurality of dots overlapping each other while controlling an overlapping area of overlapped dots or an ink jet method practiced by controlling the timing relationship among a plurality of driving signals to be applied to a plurality of heaters disposed at a single ejection outlet in order to change a quantity (volume) of ink to be ejected from the latter.

With the conventional ink jet system constructed in the above-described manner, however, plural kinds of inks, a plurality of ink supplying systems and a plurality of driving circuit systems are required for expressing a gray scale per a single pixel. As a result, there arise problems that each recording apparatus is complicated in structure, and moreover, it is produced at a comparatively expensive cost.

SUMMARY OF THE INVENTION

The present invention has been made in consideration of the aforementioned background.

An object of the present invention is to provide an ink jet apparatus which assures that an ejected ink amount can variably be controlled in response to an image signal including gray scale information by using a single ejection outlet per a single pixel, a single heater per a single pixel, a single ink supplying system and a single driving circuit without any possibility that the aforementioned problems inherent to the conventional ink jet apparatus appear.

Another object of the present invention is to provide an ink jet method to be practiced with the aid of an ink jet apparatus of the foregoing type.

In the first aspect of the present invention, there is provided an ink jet apparatus comprising:

an ink jet head including:

an ejection portion for ejecting ink therefrom, an ink passage formed in correspondence with the ejection portion, and thermal energy generating means disposed in the ink passage for generating thermal energy used for ejecting ink from the ejection portion by heating ink in the ink passage and forming a bubble in the ink;

scanning means for allowing the ink jet head to be displaced relative to an ejecting medium; and driving signal applying means for applying to the thermal energy generating means a driving signal group including at least one driving signal per a single pixel in response to an input signal during scanning operation performed by the scanning means so as to eject from the ejecting portion an ink droplet group having an independent ink droplet, wherein the driving signal applying means serves to apply the driving signal group to the ink jet head at a minimum signal interval in such a manner as to allow a volume of one ink droplet in the ink droplet group to be substantially equalized to that of other ink droplet.

In the second aspect of the present invention, there is provided an ink jet apparatus comprising:

an ink jet head including;

an ejection portion for ejecting ink therefrom, an ink passage formed in correspondence with the ejection portion, and thermal energy generating means disposed in the ink passage for generating thermal energy used for ejecting ink from the ejection portion by heating ink in the ink passage and forming a bubble in the ink;

scanning means for allowing the ink jet head to be displaced relative to an ejecting medium; and driving signal applying means for applying to the thermal energy generating means a driving signal group including at least one driving signal per a single pixel in response to an input signal during scanning operation performed by the scanning means so as to eject from the ejecting portion an ink droplet group having an independent ink droplet, wherein the driving signal applying means serves to apply the driving signal group to the ink jet head as a signal effective for increasing a volume of a first ink droplet in the ink droplet group so as to allow a volume of one ink droplet in the ink droplet group to be substantially equalized to that of other ink droplet in the ink droplet group.

In the third aspect of the present invention, there is provided an ink jet method comprising the steps of:

providing an ink jet head, ejecting an ink droplet by applying a driving signal to the ink jet head, stopping the applying of the driving signal to the ink jet head, and ejecting a next ink droplet by applying a driving signal to the ink jet head, wherein an interval time having no driving signal applied to the ink jet head is set to a minimum interval time at an interval of which the ink droplets are ejected in such manner as to allow a volume of one ink droplet to be substantially equalized to that of another ink droplet.

In the fourth aspect of the present invention, there is provided an ink jet method comprising the steps of:

preparing an ink jet head, providing an ink droplet by applying a driving signal to the ink jet head, stopping the applying of the driving signal to the ink jet head, and ejecting a next ink droplet by applying a driving signal to the ink jet head, wherein the driving signal for ejecting an ink droplet before an interval time is applied to the ink jet head as a signal effective for ejecting an ink droplet with a volume larger than that of an ink droplet in response to a driving signal applied after the interval time in such a manner as to allow the volume of ink droplets ejected at an interval times to be substantially equalized each other.

In the fifth aspect of the present invention, there is provided an ink jet apparatus performing ink ejection onto a medium by using an ink jet head including:

an ejection portion for ejecting ink therefrom, an ink passage formed in correspondence with the ejection portion, and thermal energy generating means disposed in the ink passage for generating thermal energy used for ejecting ink from the ejection portion by heating ink in the ink passage and forming a bubble in the ink, the apparatus comprising:

scanning means for allowing the ink jet head to be displaced relative to an ejecting medium; and driving signal applying means for applying to the thermal energy generating means a driving signal group including at least one driving signal per a single pixel in response to an input signal during scanning operation performed by the scanning means so as to eject from the ejecting portion an ink droplet group having an independent ink droplet, wherein the driving signal applying means serves to apply the driving signal group to the ink jet head at a minimum signal interval in such a manner as to allow a volume of one ink droplet in the ink droplet group to be substantially equalized to that of another ink droplet.

In the sixth aspect of the present invention, there is provided an ink jet apparatus performing ink ejection onto a medium by using an ink jet head including:

an ejection portion for ejecting ink therefrom:

an ink passage formed in correspondence with the ejection portion, and thermal energy generating means disposed in the ink passage for generating thermal energy used for ejecting ink from the ejection portion by heating ink in the ink passage and forming a bubble in the ink, the apparatus comprising:

scanning means for allowing the ink jet head to be displaced relative to an ejecting medium; and driving signal applying means for applying to the thermal energy generating means a driving signal group including at least one driving signal per a single pixel in response to an input signal during scanning operation performed by the scanning means so as to eject from the ejecting portion an ink droplet group having an independent ink droplet, wherein the driving signal applying means serves to apply the driving signal group to the ink jet head as a signal effective for increasing a volume of a first ink droplet in the ink droplet group so as to allow a volume of one ink droplet in the ink droplet group to be substantially equalized to that of another ink droplet in the ink droplet group.

As is apparent from the above description, according to the present invention, a series of ink droplets per a single pixel is ejected from a same single ejection portion of the ink jet head by applying a same single thermal energy generating means (i.e., a heater) a single driving signal or a plurality of driving signals each constituting a driving signal group. As will be described later, since the number of ink droplets constituting an ink droplet group can adequately be changed as desired with the ink jet apparatus, a quantity of ink to be ejected from the ink jet head can variably be controlled by changing the number of droplets corresponding to information on gray scale of image data. Thus, a quantity of ink to be ejected from the ink jet head can variably be controlled by employing a single ejecting portion per a single pixel, a heater, an ink supplying system and a driving circuit system. Consequently, the ink jet apparatus can simply and compactly be constructed so as to enable each recording operation to be achieved while exhibiting excellent gray scale properties. Especially, since a quantity of one ink droplet is equalized to that of another ink droplet, each recording operation can be performed while maintaining excellent gray scale properties.

Other objects, features and advantages of the present invention will become apparent from reading of the following description which has been made in conjunction with the accompanying drawings.

Figure 9A:
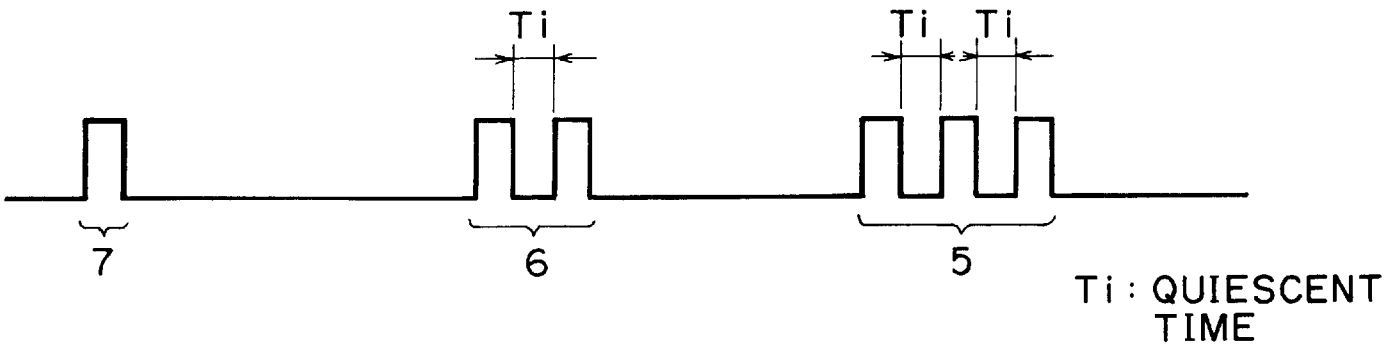
Figure 9B:
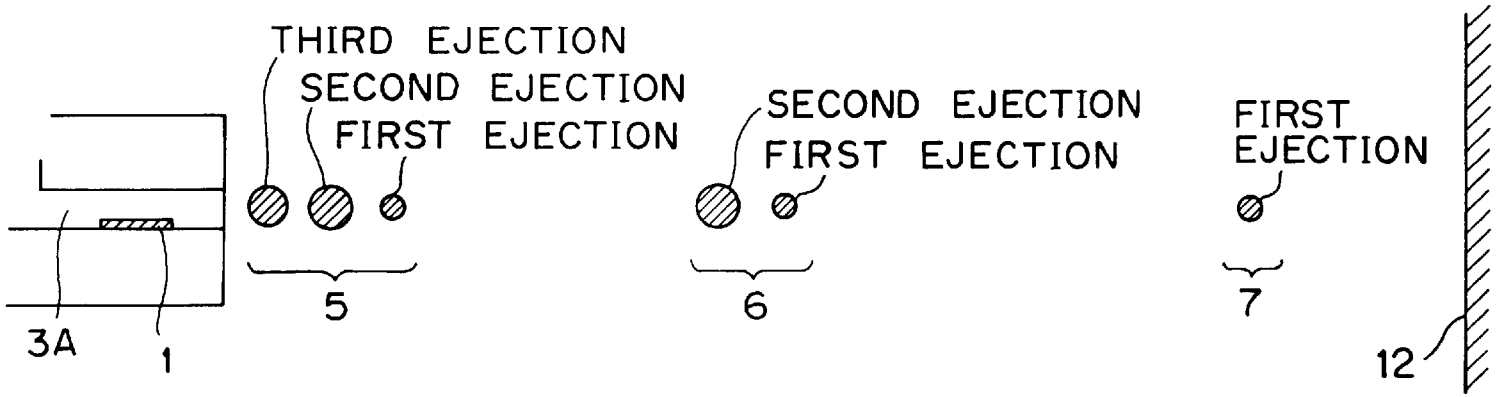
Figure 10A:
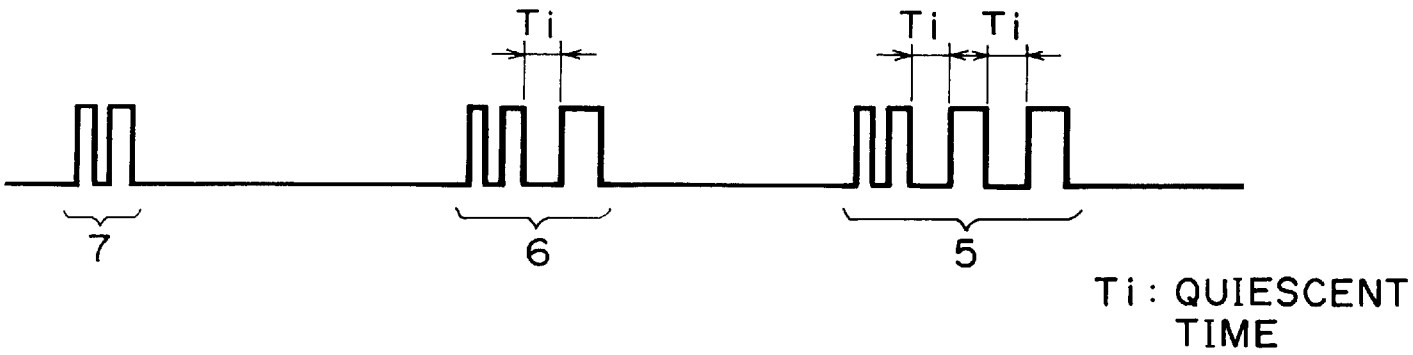
Figure 10B:
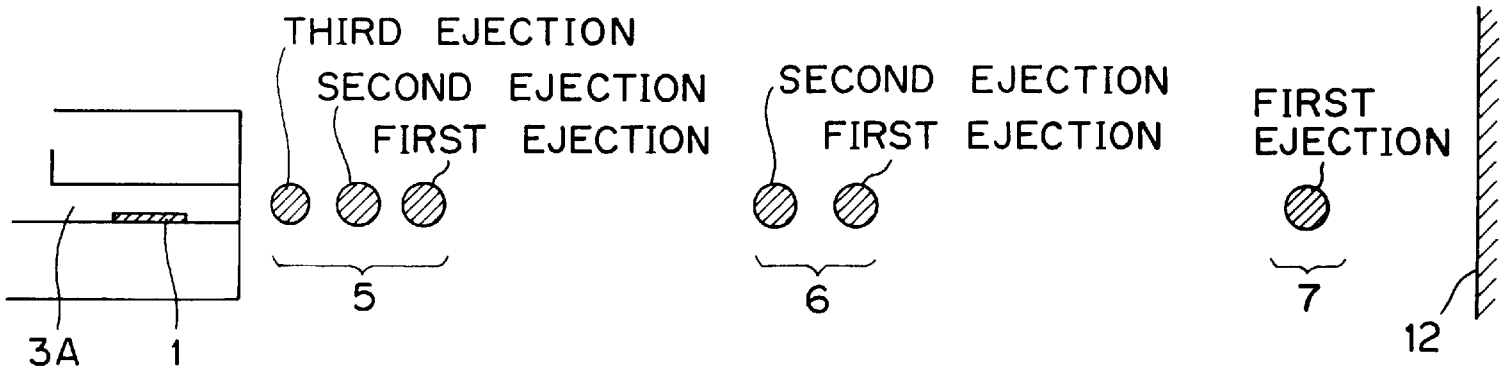
Figure 11:
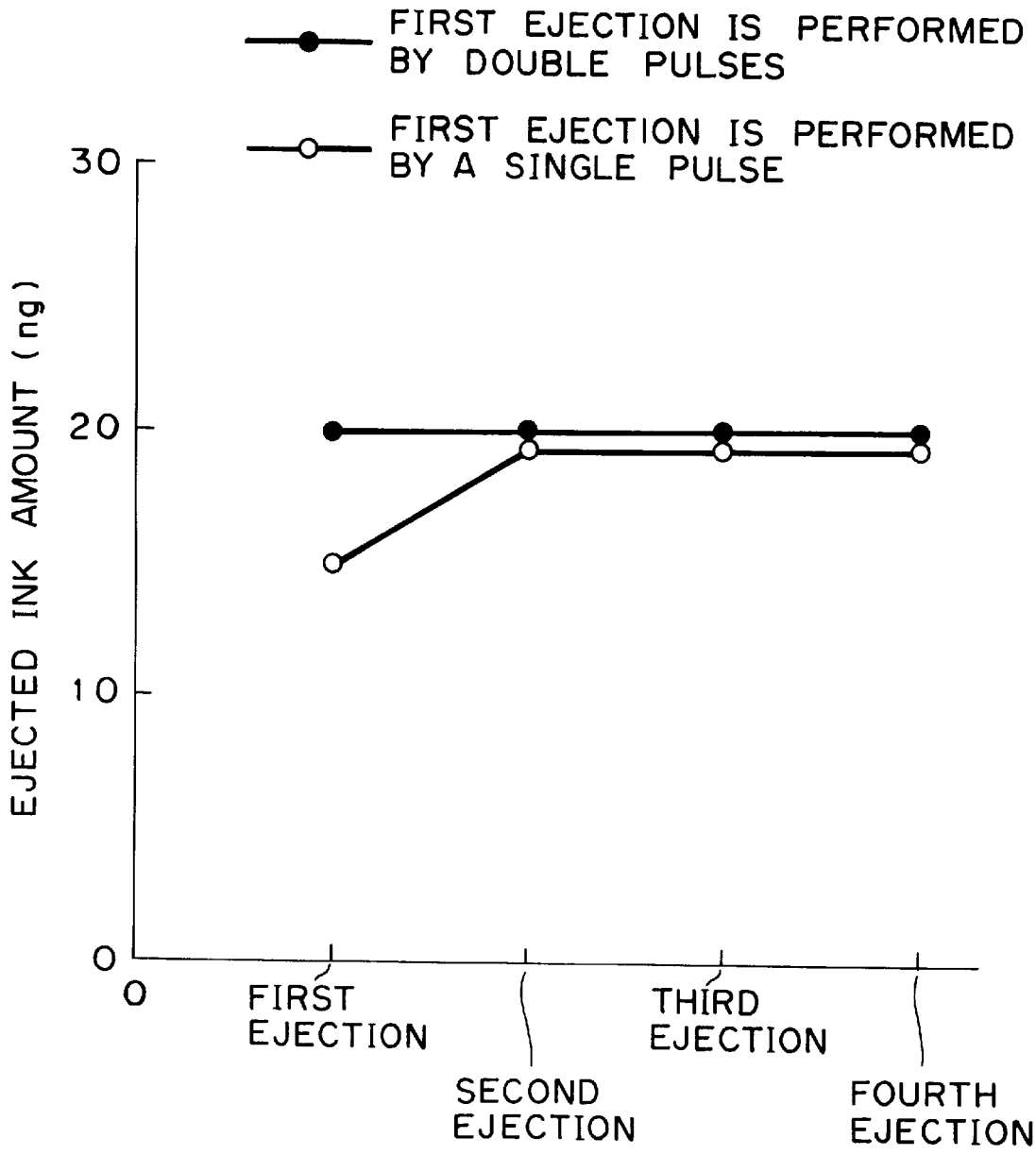
Figure 12:
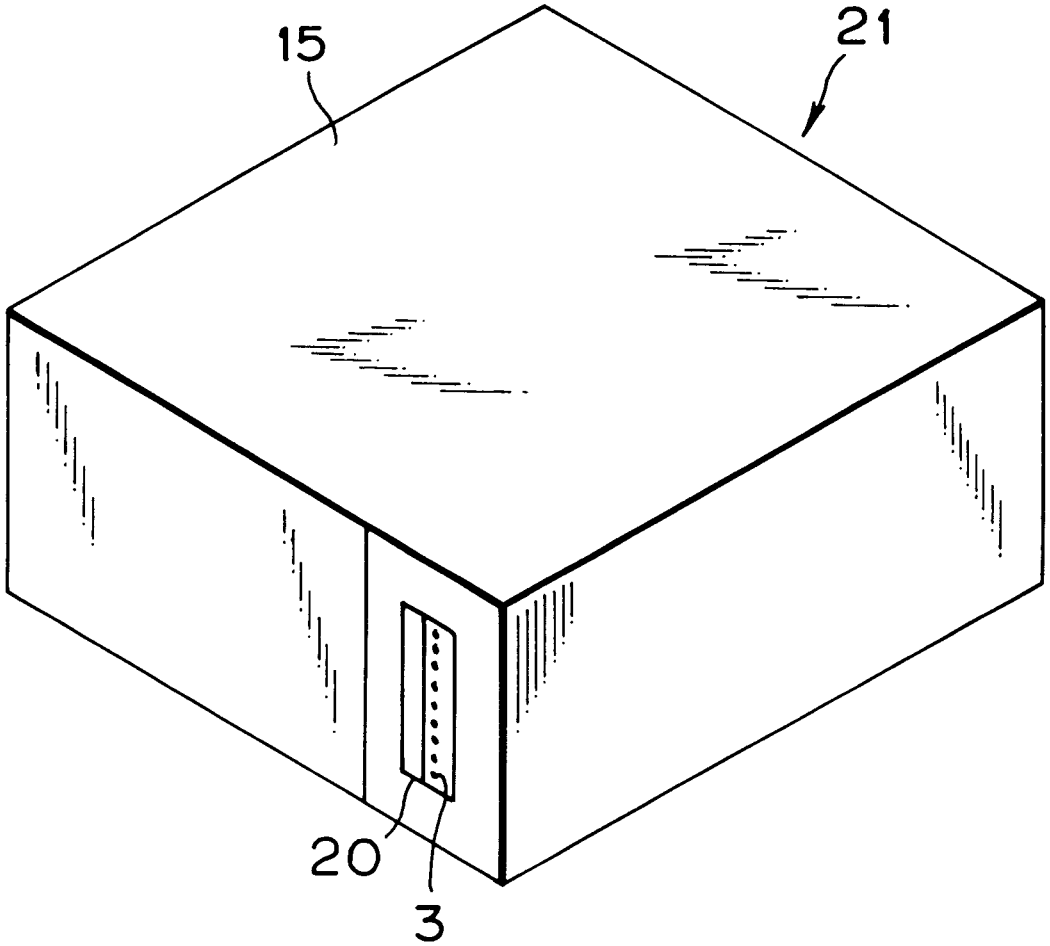
Figure 13:
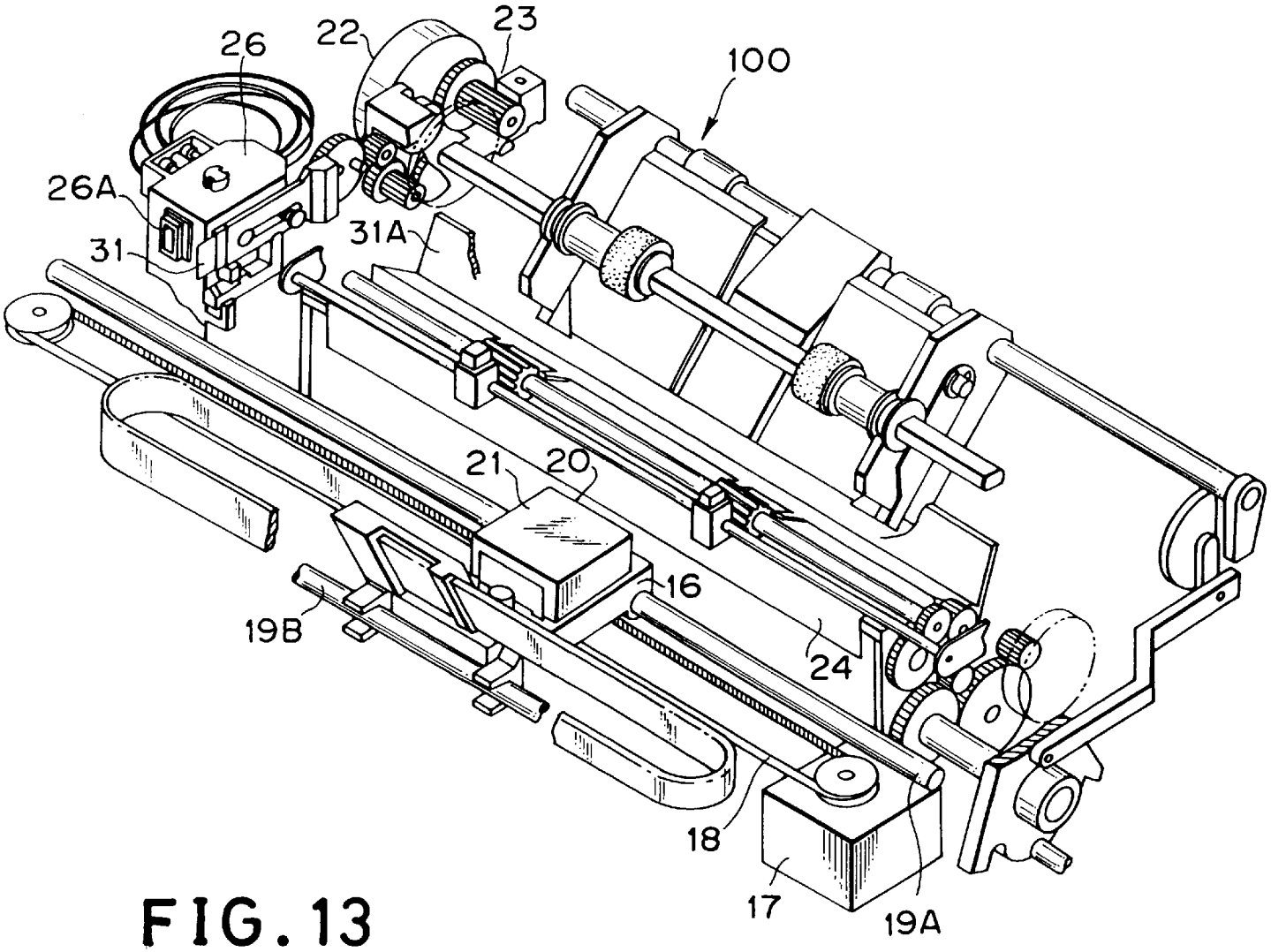
Figure 14:
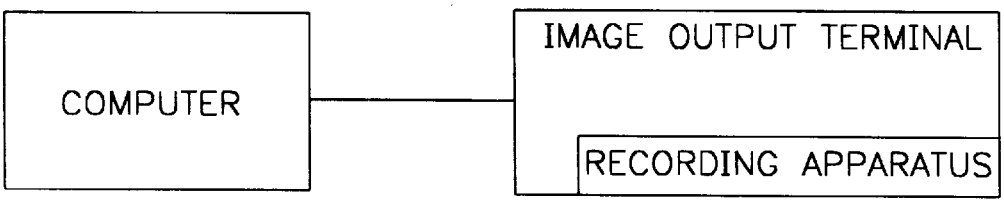
Figure 15:
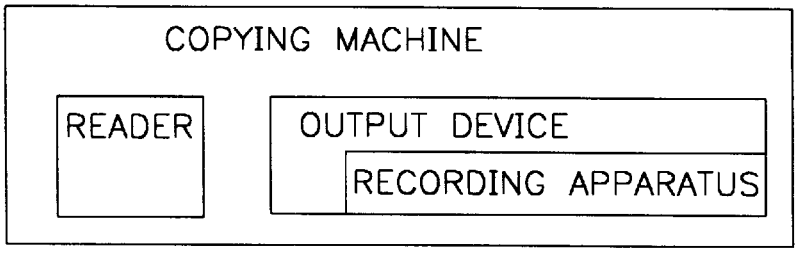
Figure 16:
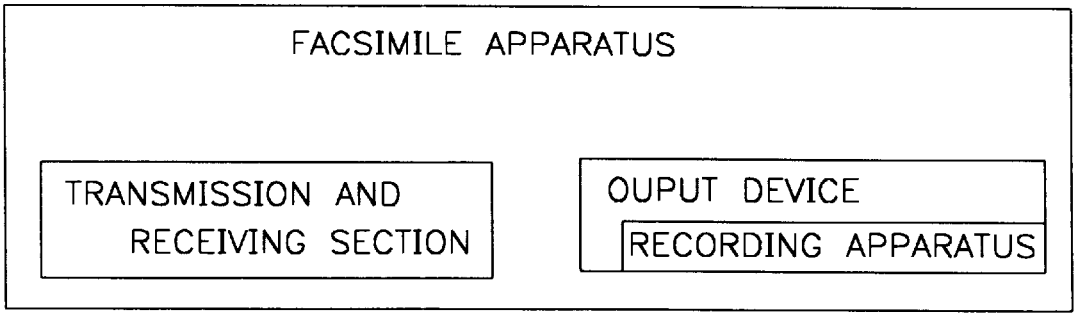

6 in the form of continuous ejection of double droplets as well as in the form of continuous ejection of triple droplets;

FIG. 9A is an illustrative view which schematically shows the structure of each driving signal generated in the case that a first droplet ejection of a droplet group is performed by a single pulse;

FIG. 9B is an illustrative view which schematically shows the state that ink droplets are ejected from an ejection outlet in response to the driving signals;

FIG. 10A is an illustrative view which schematically shows the structure of each driving signal generated in the case that a first droplet ejection of a droplet group is performed by double pulses;

FIG. 10B is an illustrative view which schematically shows the state that ink droplets are ejected from the ejection outlet in response to the driving signals;

FIG. 11 is a graph which shows the relationship between first ejection to fourth ejection and an ejected ink amount corresponding to each ejection, which are shown in both cases that a first droplet ejection of a droplet group is performed by a single pulse and that same is performed by double pulses;

FIG. 12 is a perspective view of an ink jet cartridge for an ink jet recording apparatus to which the present invention is applicable, particularly showing an appearance of the ink jet cartridge as visually observed from the outside;

FIG. 13 is a perspective view of an ink jet recording apparatus to which the present invention is applicable;

FIG. 14 is a schematic view of a computer having an image output terminal in which the recording apparatus of the present invention can be employed;

FIG. 15 is a schematic view of a copying machine in which the recording apparatus of the present invention can be employed; and FIG. 16 is a schematic view of a facsimile apparatus in which the recording apparatus of the present invention can be employed.

DESCRIPTION OF THE PREFERRED EMBODIMENTS

The present invention will now be described in detail hereinafter with reference to the accompanying drawings which illustrate a few preferred embodiments thereof.

Prior to description of the preferred embodiments of the present invention, it should be noted that the present invention has been made based on the following facts.

Generally, expansion and contraction of a bubble generated at the time of appearance of a boiling phenomenon are governed in the following two manners. Specifically, one of them is such that they are governed by thermal conduction and the other one is such that they are governed by inertia. In the case that they are governed by the thermal conduction, vaporization of liquid from the boundary plane between gas and liquid and a speed of condensation of vapor are associated with the expansion and contraction of the bubble. As far as the boiling phenomenon is concerned, a pressure in the bubble is equalized to the pressure prevailing outside of the bubble. Thus, as the heat conduction plane is heated or cooled, the bubble is thermally expanded or contracted. On the other hand, in the case that expansion and contraction of each bubble are governed by inertia, the movement of liquid induced by a pressure difference appearing between the interior of the bubble and the exterior of the same is associated with a speed of expansion and contraction of the bubble. As far as the boiling phenomenon is concerned, each bubble is not expanded and contracted in synchronization with the heating and cooling of the heat conduction plane. In the case that the boiling phenomenon appears while expansion and contraction of each bubble are governed by inertia, the bubble generated and grown by heating is caused to contract irrespective of further heating because the pressure in the bubble has been reduced. When heating is stopped while the foregoing state is maintained, the bubble disappears. However, when a heater is heated again in excess of a bubble generating temperature immediately after the bubble has disappeared, a bubble is regenerated from the liquid.

The inventor conducted a series of experiments. As a result derived from the experiments, it was confirmed that bubbles were continuously generated from the liquid as a predetermined intensity of thermal energy was continuously applied to the liquid in the timing relationship established immediately after the bubble disappeared.

In the circumstances as mentioned above, the inventor of the present invention paid attention to the fact that expansion and contraction of each bubble are governed by inertia rather than heat conduction on appearance of the boiling phenomenon associated with the ink jet system adapted to perform liquid ejection, and realized an ink jet apparatus which is constructed, in contrast with the conventional ink jet apparatus, including a process consisting of bubble generation, bubble growth, bubble contraction and bubble disappearance for forming a single pixel in such a manner that a plurality of processes each consisting of bubble generation, bubble growth, bubble contraction and bubble disappearance to form a single pixel are sequentially executed and an ejected ink amount is caused to vary depending on the number of processes practically executed as mentioned above.

(Embodiment 1)

Figure 1:
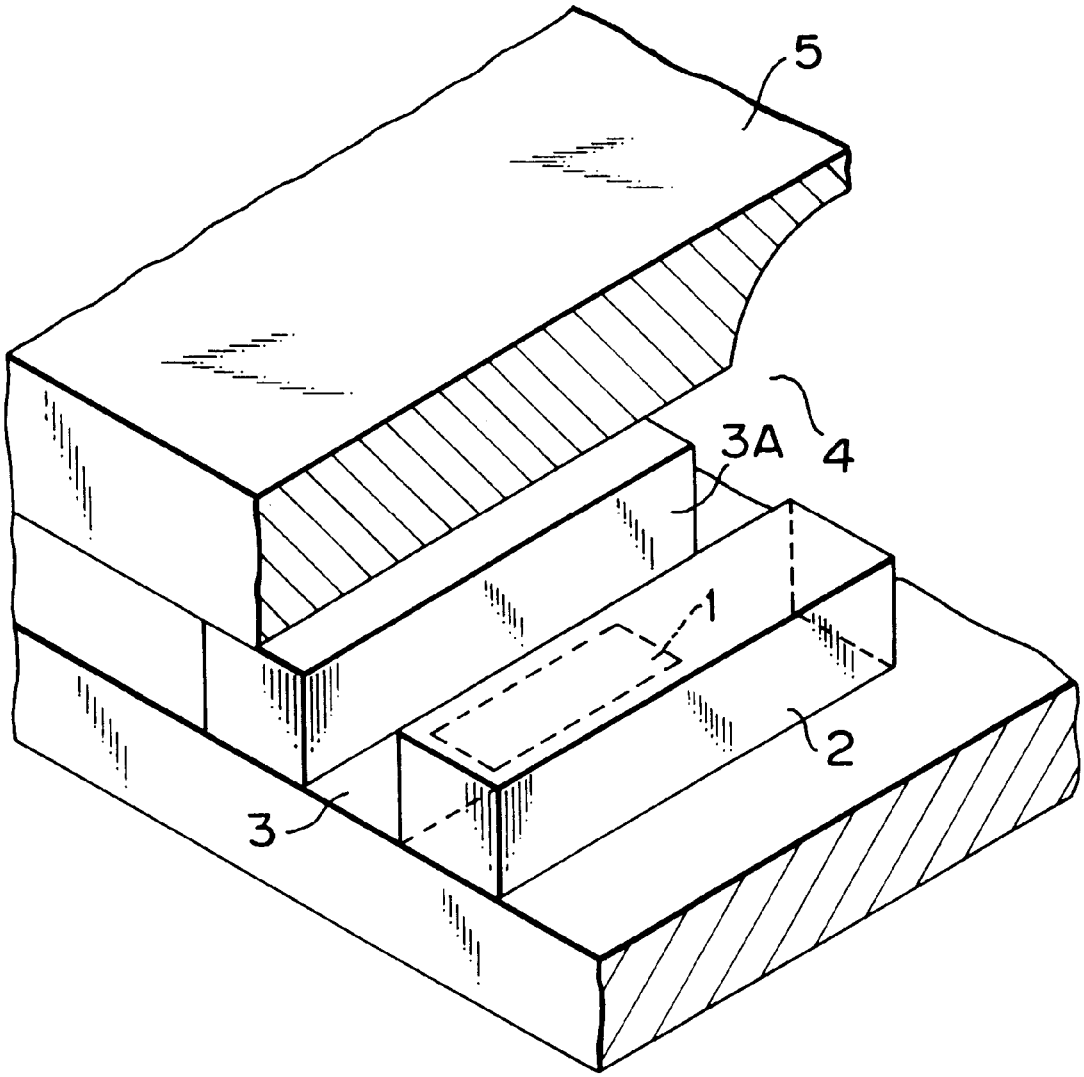
FIG. 1 is a partially exploded perspective view of an ink jet recording head constructed according to a first embodiment of the present invention, particularly showing the inner structure of the ink jet recording head.

FIG. 1 shows by way of example the inner structure of an ink jet head mounted on an ink jet recording apparatus to which the present invention is applicable. In the drawing, reference numeral 1 designates a heater which serves as a thermal energy generating means required for generating thermal energy to form air bubbles by heating ink in an ink passage 3A. The heater 1 is disposed in the ink passage 3A which is formed corresponding to an ejection portion 3 (i.e., an ejection outlet) for ejecting ink therefrom. Reference numeral 2 designates a member for forming the ejection outlet 2 and the ink passage 3A therein. The ejection outlet 3 and the ink passage 3A are communicated with an ink feed chamber (that is called a common liquid chamber).

Figure 3:
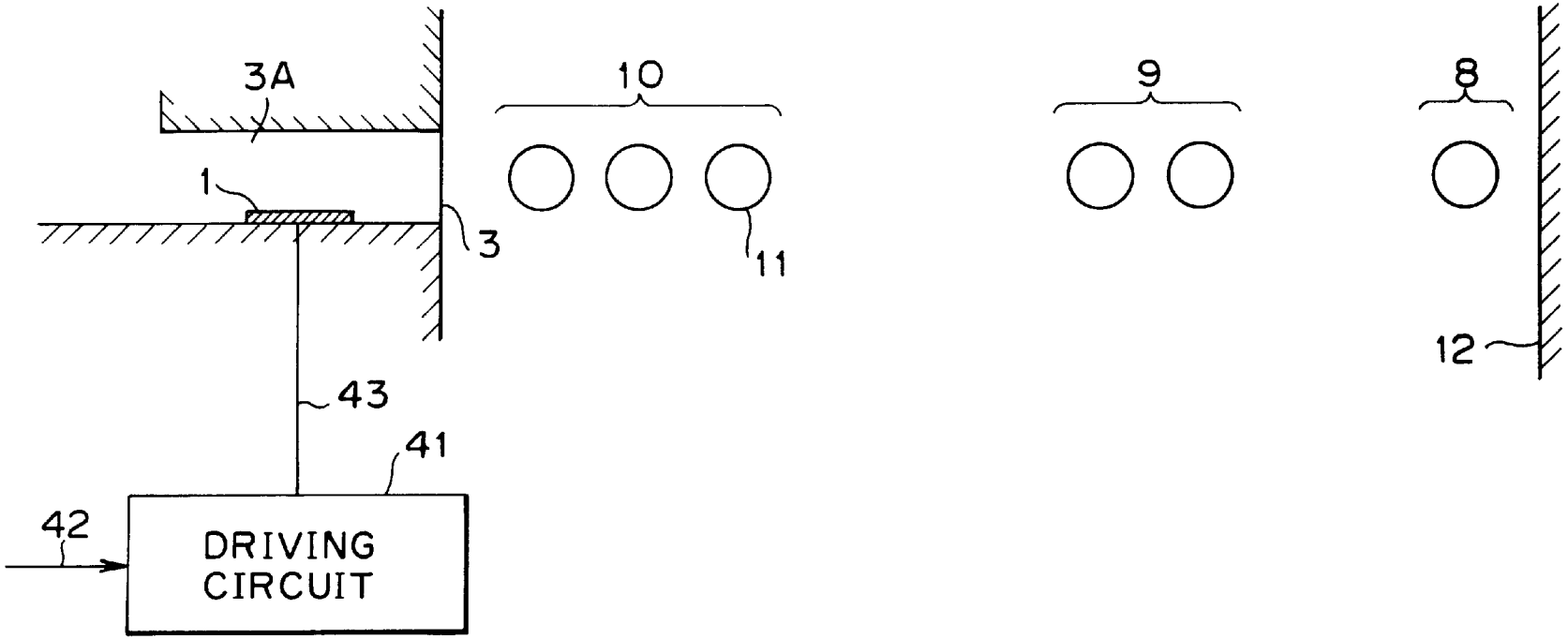
FIG. 3 is an illustrative view which shows the state that ink droplets are ejected from an ejection outlet when driving pulses shown in FIG. 2 is applied to the heater shown in FIG. 1.

A driving signal group 43 having a single driving signal or a plurality of driving signals (each of which is generated in the form of a pulse in this embodiment) generated per a single pixel are applied to the heater 1 via a driving circuit 41 serving as driving signal applying means shown in FIG. 3 in response to an input image signal 42 containing a gray scale information (or in response to a density signal).

Figure 2:
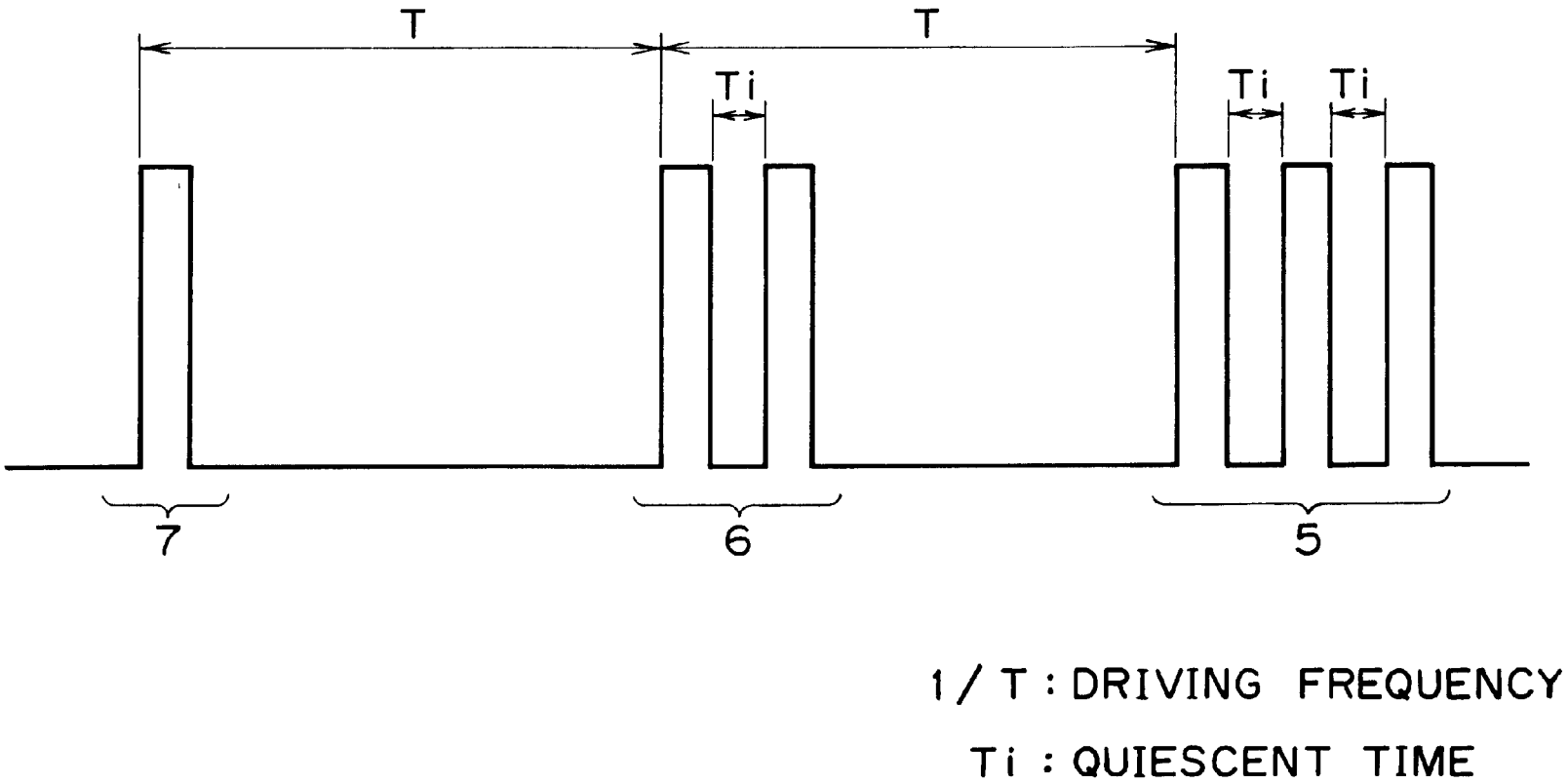
FIG. 2 is a timing chart applicable to the ink jet recording apparatus shown in FIG. 1, showing by way of example the timing relationship available among a group of driving pulses to be applied to a heater.

FIG. 2 shows by way of example the timing relationship to be established among a plurality of driving signals applied to the heater 1. In the drawing, reference numeral 7 designates a driving signal group which represents that the number of driving signals applied to the heater 1 is one, reference numeral 6 designates a driving signal group which represents that the number of driving signals applied to the heater 1 is two, and reference numeral 5 designates a driving signal group which represents that the number of driving signals applied to the heater 1 is three. Each of the driving signal groups 5, 6 and 7 is used for forming a single pixel. In addition, in FIG. 2, reference character 1/T designates a driving frequency, and reference character Ti designates an interval time (i.e., an interval between successive driving signals).

FIG. 3 shows by way of illustrative view the state that liquid droplets ejected from the ejection outlet 3 are shot toward a recording medium, e.g., a recording sheet when each of the driving signal groups 7, 6 and 5 is applied to the heater 1. Ink droplet ejected from the ejection outlet 3 in response to the driving signal group 7 shown in FIG. 2 is designated by reference numeral 8. This is hereinafter referred to as single ejection. Ink droplets continuously ejected from the ejection outlet 3 in response to the driving signal group 6 shown in FIG. 2 are designated by reference numeral 9. This is hereinafter referred to as double continuous ejection. In addition, a plurality of ink droplets continuously ejected from the ejection outlet 3 in response to the driving signal group 5 shown in FIG. 2 are designated by reference numeral 10. This is hereinafter referred to as triple continuous ejection. As is apparent from FIG. 3, the number of ink droplets constituting each droplet group is equal to the number of driving signals constituting the corresponding driving signal group. Incidentally, reference numeral 12 designates a recording sheet.

Figure 4:
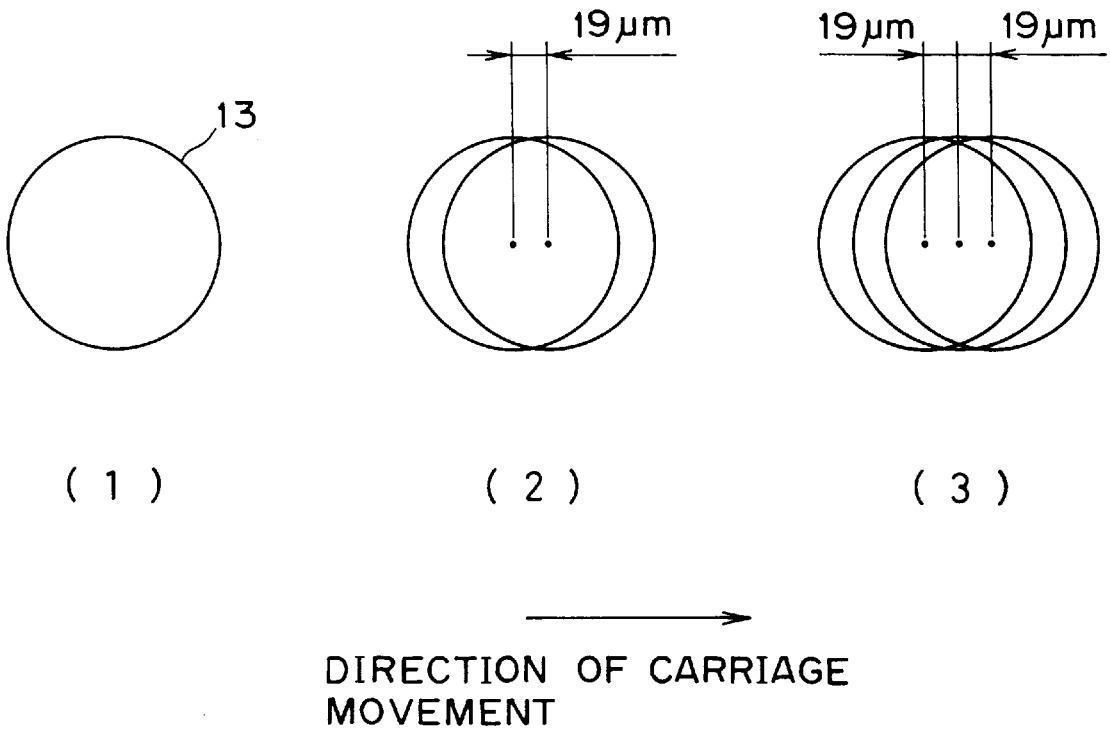
FIG. 4 shows by way of illustrative views the state that as ink droplets are ejected from the ejection outlet in response to the driving pulses shown in FIG. 2 applied to the heater shown in FIG. 1, the ink droplets are shot onto a recording sheet.

FIG. 4 shows by way of illustrative views the state that an ink droplet is shot onto the recording sheet 12 in response to the driving signal group as shown in FIG. 2, i.e., the state that a dot 13 is formed on the recording sheet 12. In this state, a distance between successive pixels is 63.5 μm, i.e., the formed dot 13 has a resolution of 400 dpi (dot per inch), each driving signal has a frequency 1/T of 3 kHz (T=333 μsec), and an interval time Ti appearing between successive driving signals is 100 μsec, i.e. a distance between adjacent dots is 19 μm. Reference characters (1), (2) and (3) in FIG. 4 comparatively designate the state that a plurality of ink droplets ejected from the ejection outlet 3 in response to the driving signal groups 7, 6 and 5 shown in FIG. 3 are shot onto the recording sheet 12. In the states (2) and (3), the overlapping state of the dot 13 having positional offsetting of the dot 13 from the initial position are caused by displacement of the ink jet head relative to the recording sheet 12 during ejection of each ink droplet.

Figure 5:
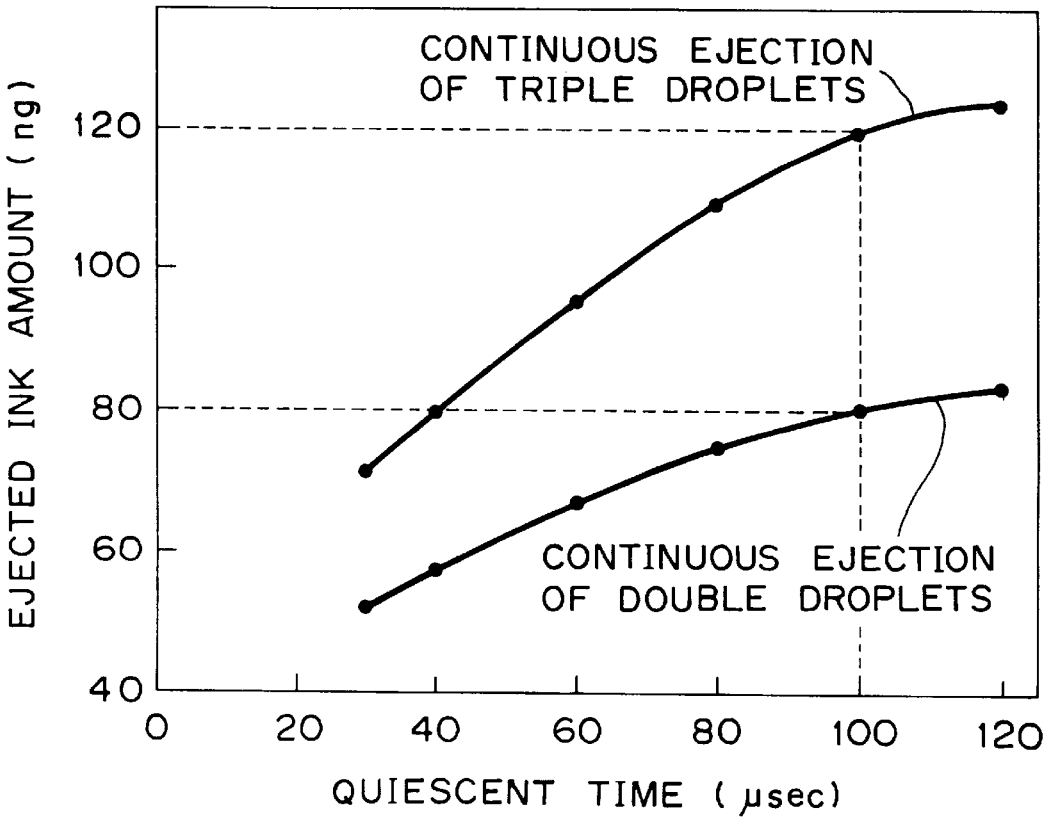
FIG. 5 is a graph which shows the relationship between an interval (quiescent) time appearing between adjacent driving signals shown in FIG. 2 and an ejected ink amount when ink droplets are ejected from the recording head shown in FIG. 1 in the form of continuous ejection of double droplets as well as in the form of continuous ejection of triple droplets.

FIG. 5 is a graph which shows the relationship between the interval time Ti appearing between successive driving signals and an ejected ink amount at the time of the triple continuous ejection effected in response to the driving signal group 5 as well as an ejected ink amount at the time of the double continuous ejection effected in response to the driving signal group 6 shown in FIG. 2. It should be noted that at the time of the single ejection, the ink jet head ejects ink by an amount of 40 ng (nanograms). As is apparent from the graph, in this embodiment, not only the shortest interval time Ti appearing when the ejected ink amount at the time of the double continuous ejection is doubled compared with the ejected ink amount at the time of the single ejection but also the shortest interval time Ti appearing when the ejected ink amount at the time of the triple continuous ejection is tripled compared with the ejected ink amount at the time of the single ejection (as represented by dotted lines in the drawing) are 100 μsec, respectively. Thus, excellent gray scale properties of the ink jet head can be exhibited by setting the interval time Ti to 100 μsec. More, specifically, it is preferable that each driving signal group is applied to the ink jet head at such a driving signal interval that an amount of each ink droplet is substantially equalized among a group of ink droplets, that is, at such a driving signal interval that a linear relationship between a total amount of ejected ink and the number of ejection is kept.

When the interval time Ti is set to 100 μsec or less, an ejected ink amount at the time of the double continuous ejection is 80 ng or less. It is considered that this is attributable to the fact that the ink jet head is insufficiently refilled with ink after completion of second ink ejection. On the other hand, when the interval time Ti is set to 100 μsec or more, the ink jet head is sufficiently refilled with ink while the ejected ink amount substantially linearly varies in conformity with the relationship shown in FIG. 5. In this embodiment, a recording time required for achieving each recording operation can be shortened by selecting the shortest interval time. In addition, in the case that the interval time is set to be long, there arises a malfunction that the positions where ink dots are shot onto the recording sheet are largely dislocated from each other, resulting in a quality of each recorded image being substantially degraded.

As shown in FIG. 2 to FIG. 5, with the ink jet recording apparatus constructed in the above-described manner, since a plurality of ink droplets are shot onto the recording sheet to form a single pixel corresponding to the gray scale employed therefor, the ink jet recording apparatus can simply be constructed with a possibility that an ejected amount can easily be controlled, and moreover, each recording operation can reliably be performed at an inexpensive cost while exhibiting excellent gray scale properties with the ink jet recording apparatus.

(Embodiment 2)

Figure 6:
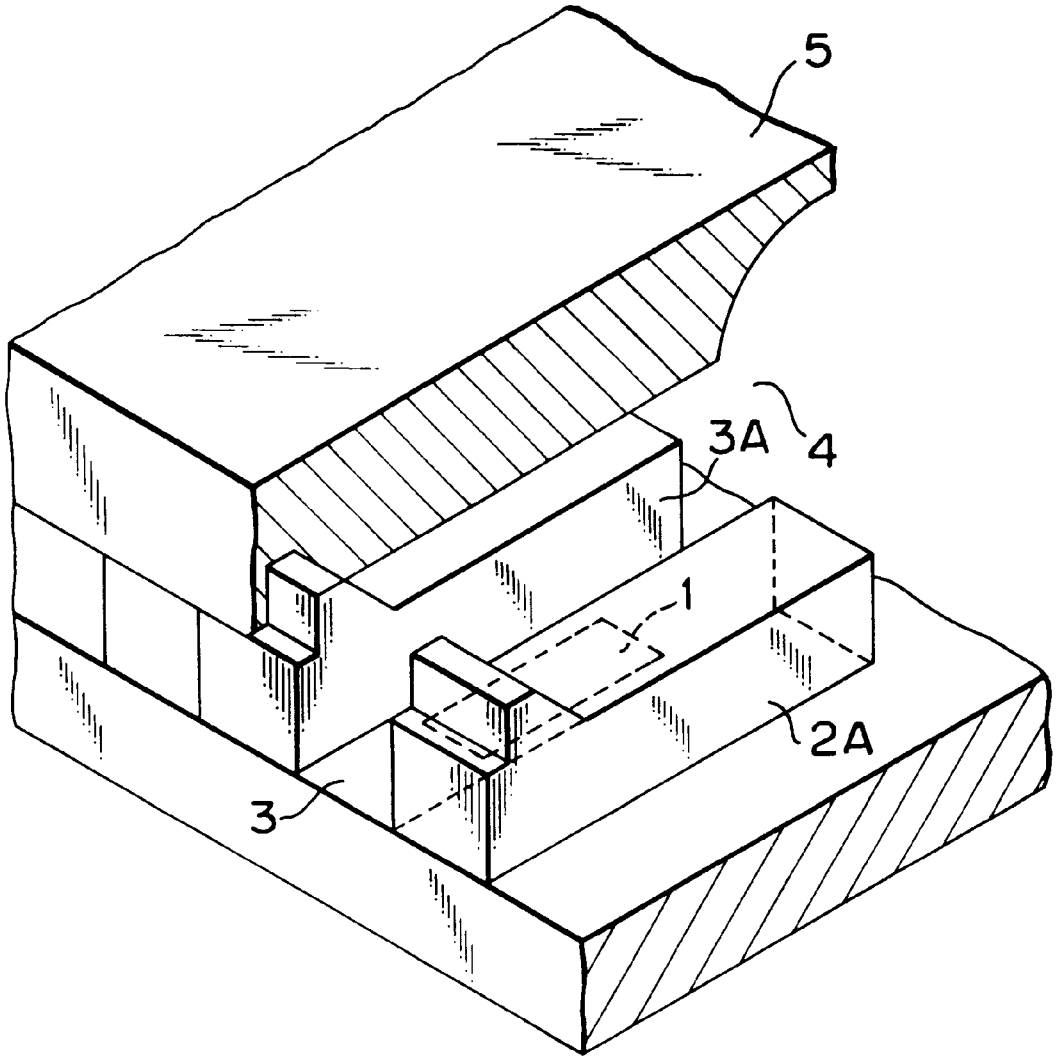
FIG. 6 is a partially exploded perspective view of an ink jet recording head constructed according to a second embodiment of the present invention, particularly showing the inner structure of the recording head.

FIG. 6 shows by way of perspective view the structure of an ink jet head constructed according to a second embodiment of the present invention. In this embodiment, in contrast with the ink jet head in the preceding embodiment, the ink jet head is constructed such that a volume of ink capable of being stored in the space located ahead of a heater 1 can be enlarged by changing the contour of an ink passage forming member 2A and a top plate 5. Specifically, a recessed part (not shown) is formed in the region located above the part corresponding to an ink passage 3A formed in the top plate 5 (while exhibiting the same contour as that of a projected part of an ink passage wall 2A), causing the capacity of storing ink in the ink jet head to be enlarged.

Figure 7:
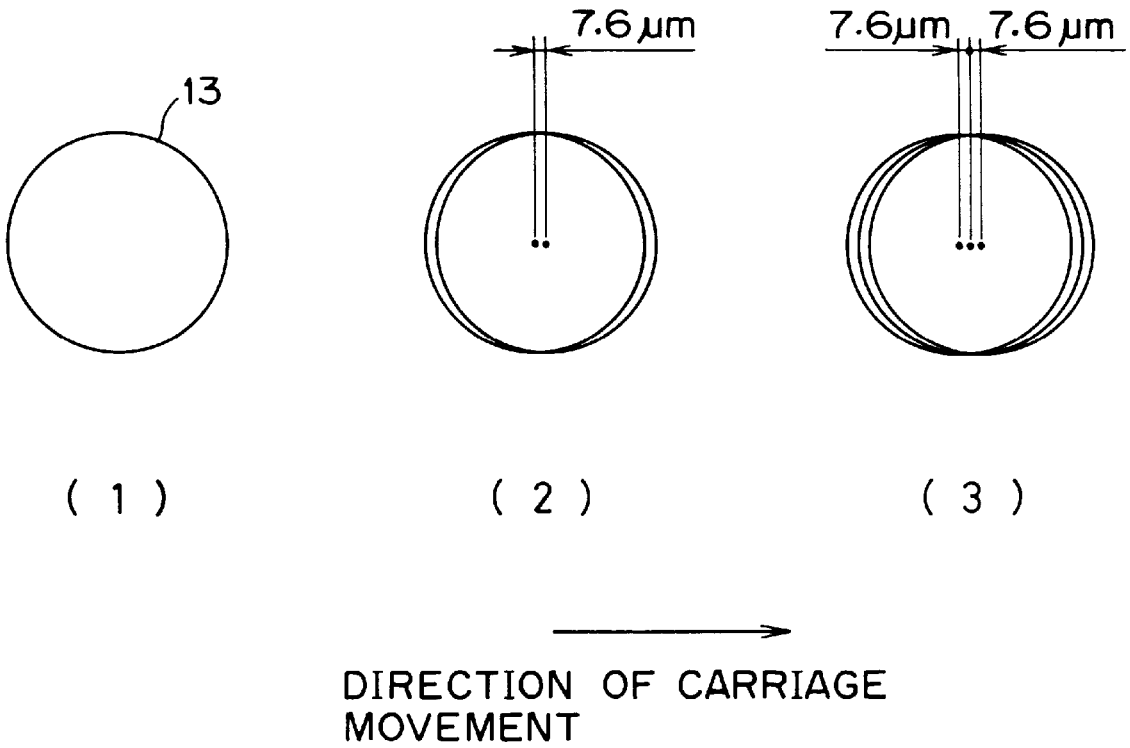
FIG. 7 shows by way of illustrative views the state that as ink droplets, are ejected from an ejection outlet in response to the driving pulses shown in FIG. 2 applied to the heater shown in FIG. 6, the droplets are shot onto a recording sheet.

FIG. 7 shows by way of illustrative views the state that an ink droplet ejected from an ink ejection outlet in response to the same driving signal groups as that in the preceding embodiment shown in FIG. 2 applied to a heater 1 shown in FIG. 6 is shot onto a recording sheet. At this time, each driving signal group has a driving frequency 1/T of 3 kHz and an interval time Ti (a time appearing between successive pulse signals) is set to 40 μsec. In other words, a distance between adjacent dots is 7.6 μm.

Figure 8:
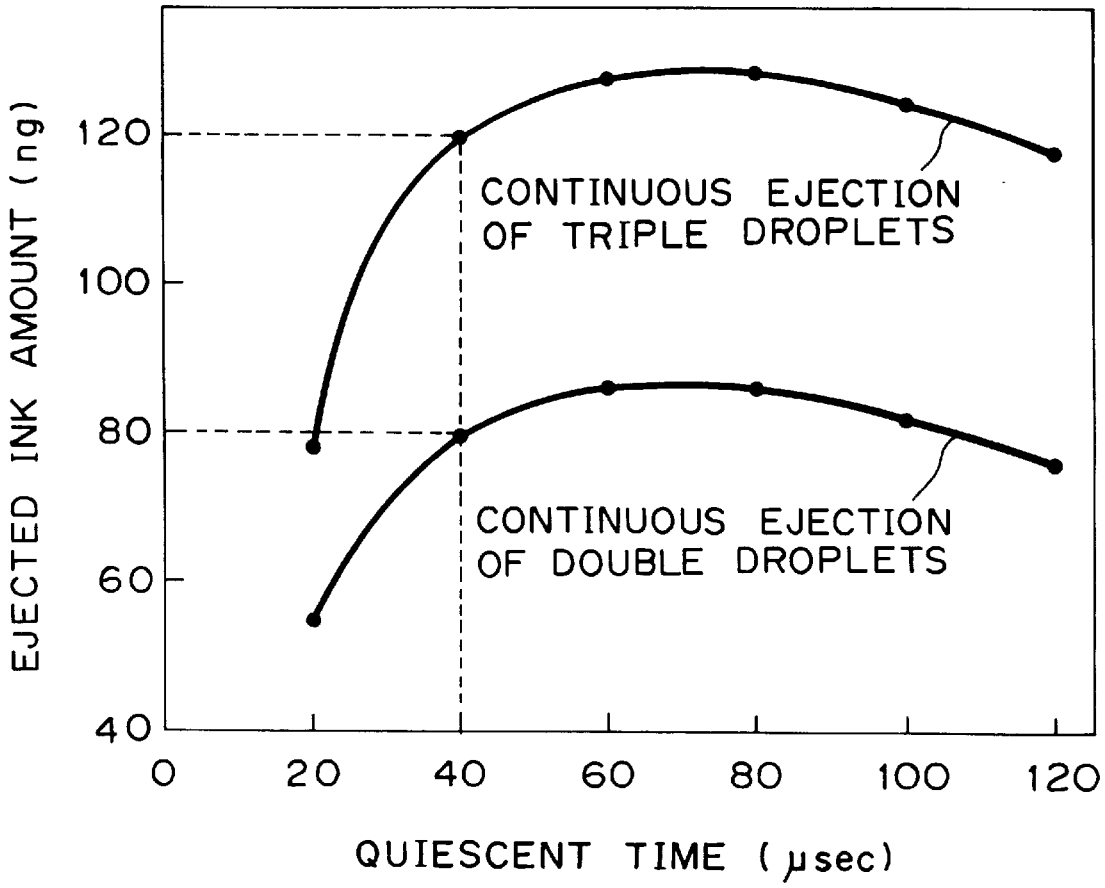
FIG. 8 is a graph which shows the relationship between an interval time appearing between adjacent driving signals shown in FIG. 2 and an ejected ink amount when ink droplets are ejected from the recording head shown in FIG.

FIG. 8 is a graph which shows a relationship between an interval time Ti and an ejected ink amount at the time of the triple continuous ejection per a single pixel as well as an ejected ink amount at the time of the double continuous ejection per a single pixel to be formed by using the ink jet head shown in FIG. 6. In this embodiment, the ink jet head assumes an ejected ink amount of 40 ng at the time of the single ejection. As is apparent from this graph, in this embodiment, not only the interval time Ti appearing when the ejected ink amount at the time of the triple continuous ejection is doubled compared with the ejected ink amount at the time of the single ejection but also the interval time Ti appearing when the ejected ink amount at the time of the double continuous ejection is tripled compared with the ejected ink amount at the time of the single ejection are 40 μsec, respectively. Thus, excellent gray scale in an image can be exhibited by setting the interval time Ti to 40 μsec. Since the ink jet head is constructed such that a volume of ink capable of being stored in the space located ahead of the heater 1 (i.e., the space located on the ejection outlet side) is enlarged, it is possible to linearly change the doubled ejected ink amount and the tripled ejected ink amount to another desired ones within the interval time shorter than that of the ink jet head described above with respect to the first embodiment of the present invention with reference to FIG. 1. The reason for this is as follows. The recess provided above the ink passage 3A makes an ink volume stored in a corresponding portion in the ink passage 3A to be larger and thereby it is difficult for the air bubble to communicate with atmospheric air at the time of ink refilling so that time required for refilling is made to be shorter. When the interval time Ti is set to 40 $\mu$sec or more, an ejected ink amount at the time of the triple droplet continuous ejection is 80 ng or more. It is considered that this is attributable to the fact that the ink jet head is sufficiently refilled with ink, and moreover, the peripheral part of the heater is heated in response to a pulse signal applied to the ink jet head after completion of first ink ejection, causing the temperature of ink to be elevated. In addition, it is also considered that the foregoing phenomenon is attributable to the fact that ink is ejected from the ejection outlet while maintaining the timing relationship for allowing the meniscus formed after the ink jet head is refilled with ink to be displaced from the ejection outlet in the forward direction.

Since the ink jet head is constructed according to the second embodiment of the present invention as described above with reference to FIG. 6 to FIG. 8, it can be concluded that the present invention has provided an ink jet recording apparatus which assures that the ejected ink amount can be controlled at a driving signal interval shorter than that of the ink jet head described above with respect to the first embodiment of the present invention with reference to FIG. 1 to FIG. 5, and moreover, each recording operation can be achieved at a high accuracy while maintaining excellent gray scale properties in recorded image by using the ink jet recording apparatus.

(Embodiment 3)

According to each of the first and second embodiments of the present invention, to assure that an ejected ink amount is caused to vary linearly, the shortest interval time for allowing the linear variation of the ejected ink amount to be minimized is selected in order to make it possible to increase the recording speed employed for performing each recording operation. On the contrary, in the embodiment, the ejected ink amount is caused to vary linearly while the volume of ejected ink droplet is increased.

As already mentioned above, after completion of the second ink ejection, the temperature of ink is elevated under the influence of heating associated with the first ink ejection, resulting in the ejection volume of droplet being increased in excess of that at the time of first ink ejection. In response to a driving signal as shown in FIG. 9A, ink is ejected from the ejection outlet while each ink droplet assumes a volume as shown in FIG. 9B. In the preceding embodiments, to assure that the ejection volume is caused to vary linearly a measure is taken such that the interval time Ti is shortened, and a quantity of ink to be ejected from the ejection outlet at the time of second ink ejection as well as at the time of third ink ejection is reduced.

In contrast with the preceding embodiment, in this embodiment, the ejected ink amount is caused to linearly vary by increasing a volume of ink droplet to be ejected from the ejection outlet at the time of first ink ejection. A volume of ink to be ejected from the ejection outlet at the time of first ink ejection can be increased by driving the ink jet head in response to double pulses as disclosed in U.S. Ser. No. 821773 filed by an assignee of the present invention. When the ejected ink amount at the time of first ink ejection is increased in response to a driving signal generated in the form of double pulses only at the time of the first ink ejection as shown in FIG. 10A, linear variation of the ejected ink amount can be achieved without any reduction of a quantity of ink to be ejected from the ejection outlet as shown in FIG. 10B.

In this embodiment, as shown in FIG. 11, in the case that a singe pulse is used as a driving signal linear variation of the ejected amount is achieved using double pulses by equalizing a amount of ink of 20 ng to be ejected from the ejection outlet at the time of first ink ejection to that at the time of second ink ejection based on an amount of ink of 15 ng to be ejected from the ejection outlet at the time of first ink ejection in the case that a single pulse is used as a driving signal.

As described above, according to the present invention, the ejection value derived from each ink ejection can reliably and easily be controlled without any possibility that the ink jet recording head is constructed in a complicated manner with large dimensions, and moreover, each recording operation can be achieved while maintaining excellent gray scale properties with the ink jet recording apparatus.

(Explanation on the whole structure of an ink jet recording apparatus)

Next, description will be made below with respect to the whole structure of an ink jet recording apparatus to which the present invention is applicable. FIG. 12 and FIG. 13 show by way of perspective views the structure of the ink jet recording apparatus to which the present invention has been applied. In the drawings, reference numeral 20 designates an ink jet head (i.e., a recording head) of the type adapted to eject ink toward a recording sheet by using bubbles generated by thermal energy. The inner structure of the ink jet head is as shown in FIG. 1 and FIG. 6. Reference numeral 21 designates a detachable ink jet cartridge integrated with the ink jet head 20. The ink jet cartridge 21 includes an ink tank 15 from which ink is fed to the ink jet head 20. Reference numeral 100 designates a main body of the ink jet recording apparatus having the ink jet cartridge 21 mounted thereon.

As is apparent from FIG. 12, i.e., a perspective view of the ink jet cartridge 21, the latter is constructed such that the foremost end of the ink jet head 20 is projected from the front surface of the ink tank 15. The ink jet head cartridge 21 is fixedly supported on a carriage 16 mounted on the main body 100 of the ink jet recording apparatus as will be described later. The ink jet head cartridge 21 is constructed in an exchangeable type such that it can be attached to and detached from the cartridge 16.

The ink tank 15 having ink to be fed to the ink jet head 20 stored therein is composed of an ink absorbing member (not shown), a container (not shown) having the ink absorbing member inserted thereinto, and a cover member (not shown) for sealably closing the container therewith. The ink tank 15 is filled with ink which is successively fed to the ink jet head 20 as ink is ejected from a plurality of ejection outlets 3 of the ink jet head 20.

The ink jet cartridge 21 constructed in the above-described manner is detachably mounted on the carriage 16 arranged in the main body 100 of the ink jet recording apparatus in conformity with a hitherto known process. As a series of recording signals are inputted into the ink jet recording apparatus, ink is ejected from the ejection outlets 3 of the ink jet head 20 to record a desired recorded image on a recording sheet while displacement of the carriage 16 relative to the recording sheet is properly controlled.

FIG. 13 shows by way of example the structure of the main body 100 of the ink jet recording apparatus including the aforementioned components. Referring to FIG. 13, the ink jet head (i.e., a recording head) 20 includes a plurality of ejection outlets 3 (see FIG. 12) each serving to eject ink therefrom toward the front surface of the recording sheet placed on a platen 24. The ink jet head 20 is mounted on the carriage 16, and an endless belt 18 for transmitting to the carriage 16 a driving power generated by a driving motor 17 is operatively connected to the carriage 16 which is bridged between two guide shafts 19A and 19B extending in parallel with each other so as to allow the carriage 16 to be slidably displaced along the guide shafts 19A and 19B. With this construction, the ink jet head 20 can reciprocably be displaced within the range defined by the whole width of the recording sheet. As the ink jet head 20 is reciprocably displaced in that way, an image is recorded on the recording sheet corresponding to the data received by the ink jet head 20. The recording sheet is transferred in the forward direction by a predetermined distance so as to perform an auxiliary scanning operation every time each main scanning operation is completed.

Reference numeral 26 designates a head recovery unit. The head recovery unit 26 is disposed at the position located opposite to the left-hand end of a displacement path of the ink jet head 20, i.e., a home position. As a motor 22 is rotationally driven, the driving power generated by the motor 22 is transmitted to the head recovery unit 26 via a power transmission mechanism 23, causing the head recovery unit 26 to be activated so as to cap the ink jet head 20 therewith. While a capping portion 26A of the head recovery device 26 is operatively associated with a capping portion of the ink jet head 20, adequate evacuating means, e.g., a pump disposed in the head recovery device 26 is activated to suck ink from the ink jet head 20 (to achieve suction recovery) in order to conduct ejection recovery treatment, e.g., removal of ink having an increased viscosity remaining in the ejection outlets 3 by forcibly discharging the foregoing ink from the ejection outlet into the head recovery device 26. In addition, the ink jet head 20 is protected by capping it with the capping portion 26A on completion of each recording operation. It should be added that the ejection recovery treatment as mentioned above is practically conducted when the ink jet head 20 is turned on or when the ink jet head 20 is exchanged with a new one or when the ink jet recording apparatus is kept inoperative for a period of time longer than a predetermined time without any recording operation performed with the ink jet head 20.

In FIG. 13, reference numeral 31 designates a blade which is disposed on the right-hand side surface of the head recovery 26 to serve as a wiping member molded of a silicone rubber. The blade 31 is held by a blade holding member 31A in a cantilever-like fashion. As the motor 22 is rotationally driven, the driving power generated by the motor 22 is transmitted to the blade 31 via the power transmission mechanism 23 in the same manner as the head recovery device 26 so as to enable the blade 31 to be engaged with the ejecting surface of the ink jet head 20. At a certain adequate intermediate time during a recording operation performed by the ink jet head 20 or after completion of the ejection recovery treatment conducted by the head recovery device 26, the blade 31 is projected in the path of displacement of the ink jet head 20 so as to wipe off dew-like condensed liquid, wetted foreign material particles, dust particles or the like on the ejecting surface of the ink jet head 20 as the latter is reciprocably displaced in that way.

The present invention achieves distinct effect when applied to a recording head or a recording apparatus which has means for generating thermal energy such as electrothermal transducers or laser light, and which causes changes in ink by the thermal energy so as to eject ink. This is because such a system can achieve a high density and high resolution recording.

A typical structure and operational principle thereof is disclosed in U.S. Pat. Nos. 4,723,129 and 4,740,796, and it is preferable to use this basic principle to implement such a system. Although this system can be applied either to on-demand type or continuous type ink jet recording systems, it is particularly suitable for the on-demand type apparatus. This is because the on-demand type apparatus has electrothermal transducers, each disposed on a sheet or liquid passage that retains liquid (ink), and operates as follows: first, one or more drive signals are applied to the electrothermal transducers to cause thermal energy corresponding to recording information; second, the thermal energy induces sudden temperature rise that exceeds the nucleate boiling so as to cause the film boiling on heating portions of the recording head; and third, bubbles are grown in the liquid (ink) corresponding to the drive signals. By using the growth and collapse of the bubbles, the ink is expelled from at least one of the ink ejection orifices of the head to form one or more ink drops. The drive signal in the form of a pulse is preferable because the growth and collapse of the bubbles can be achieved instantaneously and suitably by this form of drive signal. As a drive signal in the form of a pulse, those described in U.S. Pat. Nos. 4,463,359 and 4,345,262 are preferable. In addition, it is preferable that the rate of temperature rise of the heating portions described in U.S. Pat. No. 4,313,124 be adopted to achieve better recording.

U.S. Pat. Nos. 4,558,333 and 4,459,600 disclose the following structure of a recording head, which is incorporated to the present invention: this structure includes heating portions disposed on bent portions in addition to a combination of the ejection orifices, liquid passages and the electrothermal transducers disclosed in the above patents. Moreover, the present invention can be applied to structures disclosed in Japanese Patent Application Laid-Open Nos. 123670/1984 and 138461/1984 in order to achieve similar effects. The former discloses a structure in which a slit common to all the electrothermal transducers is used as ejection orifices of the electrothermal transducers, and the latter discloses a structure in which openings for absorbing pressure waves caused by thermal energy are formed corresponding to the ejection orifices. Thus, irrespective of the type of the recording head, the present invention can achieve recording positively and effectively.

The present invention can be also applied to a so-called full-line type recording head whose length equals the maximum length across a recording medium. Such a recording head may consists of a plurality of recording heads combined together, or one integrally arranged recording head.

In addition, the present invention can be applied to various serial type recording heads: a recording head fixed to the main assembly of a recording apparatus; a conveniently replaceable chip type recording head which, when loaded on the main assembly of a recording apparatus, is electrically connected to the main assembly, and is supplied with ink therefrom; and a cartridge type recording head integrally including an ink reservoir.

It is further preferable to add a recovery system, or a preliminary auxiliary system for a recording head as a constituent of the recording apparatus because they serve to make the effect of the present invention more reliable. As examples of the recovery system, are a capping means and a cleaning means for the recording head, and a pressure or suction means for the recording head. As examples of the preliminary auxiliary system, are a preliminary heating means utilizing electrothermal transducers or a combination of other heater elements and the electrothermal transducers, and a means for carrying out preliminary ejection of ink independently of the ejection for recording. These systems are effective for reliable recording.

The number and type of recording heads to be mounted on a recording apparatus can also be changed. For example, only one recording head corresponding to a single color ink, or a plurality of recording heads corresponding to a plurality of inks different in color or concentration can be used. In other words, the present invention can be effectively applied to an apparatus having at least one of the monochromatic, multi-color and full-color modes. Here, the monochromatic mode performs recording by using only one major color such as black. The multi-color mode carries out recording by using different color inks, and the full-color mode performs recording by color mixing.

Furthermore, although the above-described embodiments use liquid ink, inks that are liquid when the recording signal is applied can be used: for example, inks can be employed that solidify at a temperature lower than the room temperature and are softened or liquefied in the room temperature. This is because in the ink jet system, the ink is generally temperature adjusted in a range of 30° C.–70° C. so that the viscosity of the ink is maintained at such a value that the ink can be ejected reliably.

In addition, the present invention can be applied to such apparatuses where the ink is liquefied just before the ejection by the thermal energy, described as follows, so that the ink is expelled from the orifices in the liquid state, and then begins to solidify on hitting the recording medium, thereby preventing the ink evaporation: the ink is transformed from solid to liquid state by positively utilizing the thermal energy which would otherwise cause the temperature to rise; or the ink, which is dry when left in air, is liquefied in response to the thermal energy of the recording signal. In such cases, the ink may be retained in recesses or through holes formed in a porous sheet as liquid or solid substances so that the ink faces the electrothermal transducers as described in Japanese Patent Application Laid-Open Nos. 56847/1979 or 71260/1985. The present invention is most effective when it uses the film boiling phenomenon to expel the ink.

Furthermore, the ink jet recording apparatus of the present invention can be employed not only as an image output terminal of an information processing device such as a computer (FIG. 14), but also as an output device of a copying machine including a reader (FIG. 15), and as an output device of a facsimile apparatus having a transmission and receiving function (FIG. 16).

The present invention has been described in detail with respect to various embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. An ink jet apparatus comprising:

an ink jet head including an ejection portion for ejecting ink therefrom, an ink passage formed in correspondence with said ejection portion, and thermal energy generating means disposed in said ink passage for generating thermal energy used for ejecting ink from said ejection portion by heating ink in said ink passage and forming a bubble in the ink;

scanning means for allowing said ink jet head to be displaced relative to a recording medium; and driving signal applying means for applying to said thermal energy generating means a driving signal group which includes a plurality of driving signals which are continuously applied per a single pixel in response to an input signal during a scanning operation performed by said scanning means so as to eject from a same said ejecting portion an ink droplet group having independent ink droplets, wherein said driving signal applying means serves to apply the driving signal group to said thermal energy generating means at a minimum signal interval which is selected as a minimum interval from among intervals, each of the intervals may be an interval between individual driving signals in the driving signal group, each of the intervals allows a volume of one ink droplet in the ink droplet group to be substantially equalized to that of another ink droplet, and each of the intervals allows a total volume of the ink droplet group to have a linear relationship with a number of ejection times in the ink droplet group.

2. An ink jet apparatus as claimed in claim 1, wherein an ink ejecting portion side of said ink passage located ahead of said thermal energy generating means has a greater ink capacity than a portion of said ink passage located at a rear side of said thermal energy generating means.

3. An ink jet apparatus as claimed in claim 1, wherein said ink jet head includes a plurality of ejecting portions corresponding to a length of the recording medium as measured in a direction at a right angle relative to a scanning direction of the scanning operation performed by said scanning means.

4. An ink jet apparatus as claimed in claim 1, wherein said scanning means serves to displace said ink jet head relative to the recording medium in two directions for performing a scanning operation therewith, and said ink jet head ejects ink toward the recording medium during said scanning operation performed in one direction of said two directions.

5. An ink jet apparatus as claimed in claim 1, wherein said ink jet head is detachably fitted to said ink jet apparatus.

6. An ink jet apparatus as claimed in claim 1, wherein said ink jet head includes a plurality of ejection portions for ejecting plural kinds of inks each having a different color.

7. An ink jet apparatus as claimed in claim 1, wherein a maximum number of ink droplets ejected from each ejection portion in a form of an ink droplet group is two.

8. An ink jet apparatus as claimed in claim 1, wherein the maximum number of ink droplets ejected from each ejection portion in the form of an ink droplet group is three.

9. An ink jet apparatus comprising:

an ink jet head including an ejection portion for ejecting ink therefrom, an ink passage formed in correspondence with said ejection portion, and thermal energy generating means disposed in said ink passage for generating thermal energy used for ejecting ink from said ejection portion by heating ink in said ink passage and forming a bubble in the ink;

scanning means for allowing said ink jet head to be displaced relative to a recording medium; and driving signal applying means for applying to said thermal energy generating means a driving signal group which includes a plurality of driving signals which are continuously applied per a single pixel in response to an input signal during a scanning operation performed by said scanning means so as to eject from a same said ejecting portion an ink droplet group having independent ink droplets, wherein said driving signal applying means varies a signal in the driving signal group so as to increase a volume of a first ink droplet in the ink droplet group so that volumes of individual ink droplets in the ink droplet group are substantially equalized to each other, and serves to apply the driving signal group to said thermal energy generating means at a minimum signal interval which is selected as a minimum interval from among intervals, each of the intervals allows a total volume of the ink droplet group to have a linear relationship with a number of ejection times in the ink droplet group.

10. An ink jet apparatus as claimed in claim 9, wherein a driving signal generated for ejecting said first ink droplet has a plurality of pulses, and the driving signal generated for ejecting other ink droplet has a single pulse.

11. An ink jet apparatus as claimed in claim 9, wherein said ink jet head includes a plurality of ejecting portions corresponding to a length of the recording medium as measured a direction at a right angle relative to a scanning direction of the scanning operation performed by said scanning means.

12. An ink jet apparatus as claimed in claim 9, wherein said scanning means serves to displace said ink jet head relative to the recording medium in two directions for performing the scanning operation therewith, and said ink jet head ejects ink toward the recording medium during said scanning operation performed in one direction of said two directions.

13. An ink jet apparatus as claimed in claim 9, wherein said ink jet head is detachably fitted to said ink jet apparatus.

14. An ink jet apparatus as claimed in claim 9, wherein said ink jet head includes a plurality of ejection portions for ejecting plural kinds of inks each having a different color.

15. An ink jet apparatus as claimed in claim 9, wherein a maximum number of ink droplets ejected from each ejection portion in a form of an ink droplet group is two.

16. An ink jet apparatus as claimed in claim 9, wherein a maximum number of ink droplets ejected from each ejection portion in a form of an ink droplet group is three.

17. A printer operable as an output terminal of an information processing apparatus, said printer comprising:

an ink jet head including an ejection portion for ejecting ink therefrom, an ink passage formed in correspondence with said ejection portion, and thermal energy generating means disposed in said ink passage for generating thermal energy used for ejecting ink from said ejection portion by heating ink in said ink passage and forming a bubble in the ink;

scanning means for allowing said ink jet head to be displaced relative to a recording medium; and driving signal applying means for applying to said thermal energy generating means a driving signal group which includes a plurality of driving signals which are continuously applied per a single pixel in response to an input signal during a scanning operation performed by said scanning means so as to eject from a same said ejecting portion an ink droplet group having independent ink droplets, wherein said driving signal applying means serves to apply the driving signal group to said thermal energy generating means at a minimum signal interval which is selected as a minimum interval from among intervals, each of the intervals may be an interval between individual driving signals in the driving signal group, each of the intervals allows a volume of one ink droplet in the ink droplet group to be substantially equalized to that of another ink droplet, and each of the intervals allows a total volume of the ink droplet group to have a linear relationship with a number of ejection times in the ink droplet group.

18. A printer operable as an output terminal of an information processing apparatus, said printer comprising:

an ink jet head including an ejection portion for ejecting ink therefrom, an ink passage formed in correspondence with said ejection portion, and thermal energy generating means disposed in said ink passage for generating thermal energy used for ejecting ink from said ejection portion by heating ink in said ink passage and forming a bubble in the ink;

scanning means for allowing said ink jet head to be displaced relative to a recording medium; and driving signal applying means for applying to said thermal energy generating means a driving signal group which includes a plurality of driving signals which are continuously applied per a single pixel in response to an input signal during a scanning operation performed by said scanning means so as to eject from a same said ejecting portion an ink droplet group having independent ink droplets, wherein said driving signal applying means varies a signal in the driving signal group so as to increase a volume of a first ink droplet in the ink droplet group so that volumes of individual ink droplets in the ink droplet group are substantially equalized to each other, and serves to apply the driving signal group to said thermal energy generating means at a minimum signal interval which is selected as a minimum interval from among intervals, each of the intervals allows a total volume of the ink droplet group to have a linear relationship with a number of ejection times in the ink droplet group.

19. A facsimile apparatus comprising:

means for transmitting and receiving a signal;

an ink jet head including an ejection portion for ejecting ink therefrom, an ink passage formed in correspondence with said ejection portion, and thermal energy generating means disposed in said ink passage for generating thermal energy used for ejecting ink from said ejection portion by heating ink in said ink passage and forming a bubble in the ink;

scanning means for allowing said ink jet head to be displaced relative to a recording medium; and driving signal applying means for applying to said thermal energy generating means a driving signal group which includes a plurality of driving signals which are continuously applied per a single pixel in response to an input signal during a scanning operation performed by said scanning means so as to eject from a same said ejecting portion an ink droplet group having independent ink droplets, wherein said driving signal applying means serves to apply the driving signal group to said thermal energy generating means at a minimum signal interval which is selected as a minimum interval from among intervals, each of the intervals may be an interval between individual driving signals in the driving signal group, each of the intervals allows a volume of one ink droplet in the ink droplet group to be substantially equalized to that of another ink droplet, and each of the intervals allows a total volume of the ink droplet group to have a linear relationship with a number of ejection times in the ink droplet group.

20. A facsimile apparatus comprising:

means for transmitting and receiving a signal;

an ink jet head including an ejection portion for ejecting ink therefrom, an ink passage formed in correspondence with said ejection portion, and thermal energy generating means disposed in said ink passage for generating thermal energy used for ejecting ink from said ejection portion by heating ink in said ink passage and forming a bubble in the ink;

scanning means for allowing said ink jet head to be displaced relative to a recording medium; and driving signal applying means for applying to said thermal energy generating means a driving signal group which includes a plurality of driving signals which are continuously applied per a single pixel in response to an input signal during a scanning operation performed by said scanning means so as to eject from a same said ejecting portion an ink droplet group having independent ink droplets, wherein said driving signal applying means varies a signal in the driving signal group so as to increase a volume of a first ink droplet in the ink droplet group so that volumes of individual ink droplets in the ink droplet group are substantially equalized to each other, and serves to apply the driving signal group to said thermal energy generating means at a minimum signal interval which is selected as a minimum interval from among intervals, each of the intervals allows a total volume of the ink droplet group to have a linear relationship with a number of ejection times in the ink droplet group.

21. A copying apparatus comprising:

a reader;

an ink jet head including an ejection portion for ejecting ink therefrom, an ink passage formed in correspondence with said ejection portion, and thermal energy generating means disposed in said ink passage for generating thermal energy used for ejecting ink from said ejection portion by heating ink in said ink passage and forming a bubble in the ink;

scanning means for allowing said ink jet head to be displaced relative to a recording medium; and driving signal applying means for applying to said thermal energy generating means a driving signal group which includes a plurality of driving signals which are continuously applied per a single pixel in response to an input signal during a scanning operation performed by said scanning means so as to eject from a same said ejecting portion an ink droplet group having independent ink droplets, wherein said driving signal applying means serves to apply the driving signal group to said thermal energy generating means at a minimum signal interval which is selected as a minimum interval from among intervals, each of the intervals may be an interval between individual driving signals in the driving signal group, each of the intervals allows a volume of one ink droplet in the ink droplet group to be substantially equalized to that of another ink droplet, and each of the intervals allows a total volume of the ink droplet group to have a linear relationship with a number of ejection times in the ink droplet group.

22. A copying apparatus comprising:

a reader;

an ink jet head including an ejection portion for ejecting ink therefrom, an ink passage formed in correspondence with said ejection portion, and thermal energy generating means disposed in said ink passage for generating thermal energy used for ejecting ink from said ejection portion by heating ink in said ink passage and forming a bubble in the ink;

scanning means for allowing said ink jet head to be displaced relative to a recording medium; and driving signal applying means for applying to said thermal energy generating means a driving signal group which includes a plurality of driving signals which are continuously applied per a single pixel in response to an input signal during a scanning operation performed by said scanning means so as to eject from a same said ejecting portion an ink droplet group having independent ink droplets, wherein said driving signal applying means varies a signal in the driving signal group so as to increase a volume of a first ink droplet in the ink droplet group so that volumes of individual ink droplets in the ink droplet group are substantially equalized to each other, and serves to apply the driving signal group to said thermal energy generating means at a minimum signal interval which is selected as a minimum interval from among intervals, each of the intervals allows a total volume of the ink droplet group to have a linear relationship with a number of ejection times in the ink droplet group.

23. An ink jet method comprising the steps of:

providing an ink jet head, ejecting an ink droplet from an ejecting portion of the ink jet head by applying a first driving signal to the ink jet head, stopping the applying of the first driving signal to the ink jet head, and ejecting a next ink droplet from a same ejecting portion, from which the ink droplet is ejected by applying the first driving signal, by applying a second driving signal to the ink jet head, wherein an interval time of stopping applying the first driving signal to the ink jet head is set to a minimum interval time, the minimum interval time being selected as a minimum interval from among intervals, each of the intervals may be an interval between individual driving signals in the driving signal group, each of the intervals allows volumes of individual ink droplets to be substantially equalized to each other, and each of the intervals allows a total volume of the ink droplets to have a linear relationship with a number of ink droplet ejection times.

24. An ink jet method comprising the steps of:

preparing an ink jet head, ejecting an ink droplet from an ejecting portion of the ink jet head by applying a first driving signal to the ink jet head, stopping the applying of the first driving signal to the ink jet head, and ejecting a next ink droplet from a same ejecting portion, from which the ink droplet is ejected by applying the first driving signal, by applying a second driving signal to the ink jet head, wherein the first driving signal is varied so as to eject an ink droplet with a volume larger than that of an ink droplet ejected by the second driving signal applied after stopping applying the first driving signal so that volumes of ink droplets ejected at an interval time which is a time of stopping applying the driving signal are substantially equalized to each other, and a minimum signal interval is selected as a minimum interval from among intervals, each of the intervals allows a total volume of the ink droplets to have a linear relationship with a number of ink droplet ejection times.

25. An ink jet apparatus for performing ink ejection onto a medium with an ink jet head including an ejection portion for ejecting ink therefrom, an ink passage formed in correspondence with said ejection portion, and thermal energy generating means disposed in said ink passage for generating thermal energy used for ejecting ink from said ejection portion by heating ink in said ink passage and forming a bubble in the ink, said apparatus comprising:

scanning means for allowing said ink jet head to be displaced relative to a recording medium; and driving signal applying means for applying to said thermal energy generating means a driving signal group which includes a plurality of driving signals which are continuously applied per a single pixel in response to an input signal during a scanning operation performed by said scanning means so as to eject from a same said ejecting portion an ink droplet group having independent ink droplets, wherein said driving signal applying means serves to apply the driving signal group to said thermal energy generating means at a minimum signal interval which is selected as a minimum interval from among intervals, each of the intervals may be an interval between individual driving signals in the driving signal group, each of the intervals allows a volume of one ink droplet in the ink droplet group to be substantially equalized to that of another ink droplet, and each of the intervals allows a total volume of the ink droplet group to have a linear relationship with a number of ejection times in the ink droplet group.

26. An ink jet apparatus for performing ink ejection onto a medium with an ink jet head including an ejection portion for ejecting ink therefrom, an ink passage formed in correspondence with said ejection portion, and thermal energy generating means disposed in said ink passage for generating thermal energy used for ejecting ink from said ejection portion by heating ink in said ink passage and forming a bubble in the ink, said apparatus comprising:

scanning means for allowing said ink jet head to be displaced relative to a recording medium; and driving signal applying means for applying to said thermal energy generating means a driving signal group which includes a plurality of driving signals which are continuously applied per a single pixel in response to an input signal during a scanning operation performed by said scanning means so as to eject from a same said ejecting portion an ink droplet group having independent ink droplets, wherein said driving signal applying means varies a signal in the driving signal group so as to increase a volume of a first ink droplet in the ink droplet group so that volumes of individual ink droplets in the ink droplet group are substantially equalized to each other, and serves to apply the driving signal group to said thermal energy generating means at a minimum signal interval which is selected as a minimum interval from among intervals, each of the intervals allows a total volume of the ink droplet group to have a linear relationship with a number of ejection times in the ink droplet group.

* * * * *

UNITED STATES PATENT AND TRADEMARK OFFICE

CERTIFICATE OF CORRECTION

PATENT NO. : 6,022,092

DATED : February 8, 2000

INVENTOR(S) : MISUMI

It is certified that error appears in the above-identified patent and that said Letters Patent is hereby corrected as shown below:

COLUMN 3:
Line 14, "equalized" should read --equalized with--.

COLUMN 4:
Line 42, "is" should read --are--.

COLUMN 7:
Line 61, "More," should read --More--.

COLUMN 9:
Line 5, "another" should read --other--.

COLUMN 10:
Line 2, "821773" should read --821,773--.
Line 13, "a" should read --an--.

COLUMN 15:
Line 25, "measured" should read --measured in--.

Signed and Sealed this

Twentieth Day of March, 2001

Nicholas P. Godici

*Attest:*

NICHOLAS P. GODICI

*Attesting Officer*

*Acting Director of the United States Patent and Trademark Office*